United States Patent [19]

Hight, Jr.

[11] 4,186,166

[45] Jan. 29, 1980

[54] METHOD FOR PRODUCING CONCRETE PANEL HAVING FRACTURED RIB FINISH

[75] Inventor: Henry D. Hight, Jr., Fort Worth, Tex.

[73] Assignee: Martin Concrete Engineering Company, Fort Worth, Tex.

[21] Appl. No.: 871,744

[22] Filed: Jan. 23, 1978

Related U.S. Application Data

[60] Division of Ser. No. 785,067, Apr. 6, 1977, Pat. No. 4,088,112, which is a continuation-in-part of Ser. No. 722,586, Sep. 13, 1976, abandoned.

[51] Int. Cl.[2] ..... B28D 1/26; B28B 1/29

[52] U.S. Cl. ..... 264/139; 264/70; 264/145; 264/162; 264/163; 264/177 R; 264/228; 264/233; 264/293; 264/296

[58] Field of Search ..... 264/162, 293, 70, 139, 264/145, 163, 177, 228, 233, 296

[56] References Cited

U.S. PATENT DOCUMENTS

| | | | |
|---|---|---|---|
| 3,049,786 | 8/1962 | Jones | 425/63 |
| 3,061,904 | 11/1962 | Wise | 425/440 |
| 3,142,106 | 7/1964 | Wise et al. | 425/440 |
| 3,348,279 | 10/1967 | Shoe | 425/440 |
| 3,545,140 | 12/1970 | Jones | 51/171 PT |
| 3,770,360 | 11/1973 | Shoe | 425/440 |
| 3,775,529 | 11/1973 | Steenson | 264/293 X |
| 3,821,347 | 6/1974 | Katoh | 264/162 |
| 3,867,503 | 2/1975 | Shoe | 264/313 |

*Primary Examiner*—Thomas P. Pavelko
*Attorney, Agent, or Firm*—Hubbard, Thurman, Turner, Tucker & Glaser

[57] ABSTRACT

Method and apparatus for producing a concrete panel having a fractured rib finish is disclosed. A quantity of relatively low slump concrete mixture is cast upon a pallet in the form of a panel and is extruded to define projecting ribs and channels. The casting is permitted to harden until the concrete becomes rigid but not completely set. Thereafter an array of wedges secured to a carriage assembly is drawn along the length of the panel with each wedge disposed in shearing engagement with edge portions of an adjacent pair of ribs. Each wedge includes a shoulder portion wider than the channel for shearing and forcibly displacing portions of the ribs as the wedge is drawn through the channel. Means are provided for propelling the carriage assembly along the length of the panel and in a direction parallel to the orientation of the ribs. A concrete panel having a fractured rib finish produced by the method of the invention is similar in appearance to a concrete panel having a manually hammered rib finish.

2 Claims, 7 Drawing Figures

METHOD FOR PRODUCING CONCRETE PANEL HAVING FRACTURED RIB FINISH

CROSS REFERENCE TO RELATED APPLICATIONS

This is a divisional of application Ser. No. 785,067 filed Apr. 6, 1977 now U.S. Pat. No. 4,088,112 which is a continuation-in-part of application Ser. No. 722,586, entitled "Concrete Panel Extruding Method and Apparatus" filed Sept. 13, 1976 now abandoned. The present application incorporates by reference the subject matter disclosed in that co-pending application, which was filed by Henry D. Hight, Jr., and William C. Weikert, and assigned to the assignee of the present invention.

BACKGROUND OF THE INVENTION

1. Field of the Invention

The invention relates to the art of casting concrete products, and more particularly, relates to method and apparatus for producing a concrete panel having a fractured rib finish.

2. Description of the Prior Art

Machine extruded, precast structural concrete panels may be provided with a variety of architectural surface finishes. One popular architectural surface finish for precast panels is the ribbed top finish which may be produced automatically during casting, for example as disclosed in our co-pending application Ser. No. 722,586. A variation of the fractured rib finish is the hammered rib finish which is produced by manually hammering and chiseling the ribs to break away portions of the ribs and expose the underlying aggregate material. This procedure provides an aesthetically pleasing architectural finish comprising alternate strips of a relatively smooth surface and a relatively rough exposed aggregate surface. The manual hammering procedure is extremely tedious and substantially increases the installation cost of the panels. Furthermore, since the hammering procedure is usually carried out after the panels have been installed at the job site, the total time required for completion of construction is also increased.

SUMMARY OF THE INVENTION

According to the present invention, method and apparatus are disclosed for producing a concrete panel having a fractured rib finish which is similar in appearance to a manually hammered rib finish. A quantity of relatively low slump concrete mixture is cast on a pallet in the form of a panel. The casting is extruded to define projecting ribs and channels in a parallel pattern along the length of the panel. The casting is permitted to harden until the concrete becomes rigid but not completely set. Wedges are drawn through the channels along the length of the panel for shearing and forcibly displacing portions of the adjacent ribs. The application of a shearing force against the ribs in a direction substantially parallel to the orientation of the ribs and perpendicular to a plane containing a right angle cross section of the ribs produces a irregular fracture line across the face of each rib as the wedges are drawn through the channels.

The apparatus for producing the fractured rib surface comprises generally a pallet for supporting the concrete slab in a position which permits access to its ribbed surface and a carriage mounted for movement along the length of the pallet in a direction parallel to the orientation of the ribs. An array of wedges is secured to the carriage with each of the wedges having a nose portion for insertion into a channel lying between an adjacent pair of ribs. Each wedge is provided with a shoulder portion which is wider than the channel for shearing and forcibly displacing portions of the adjacent ribs as the wedge is drawn through the channel. Means are provided for propelling the carriage along the length of the slab and in a direction parallel to the orientation of the ribs with the wedges disposed in shearing engagement with the rib portions.

BRIEF DESCRIPTION OF THE DRAWING

The novel features which characterize the invention are set forth in the appended claims. The invention itself, however, as well as other objects and advantages thereof, may best be understood by reference to the following detailed description of a preferred embodiment, when read in conjunction with the accompanying drawing, wherein:

DETAILED DESCRIPTION

Figures 1, 2, 3, 4, 5, 6, 7:
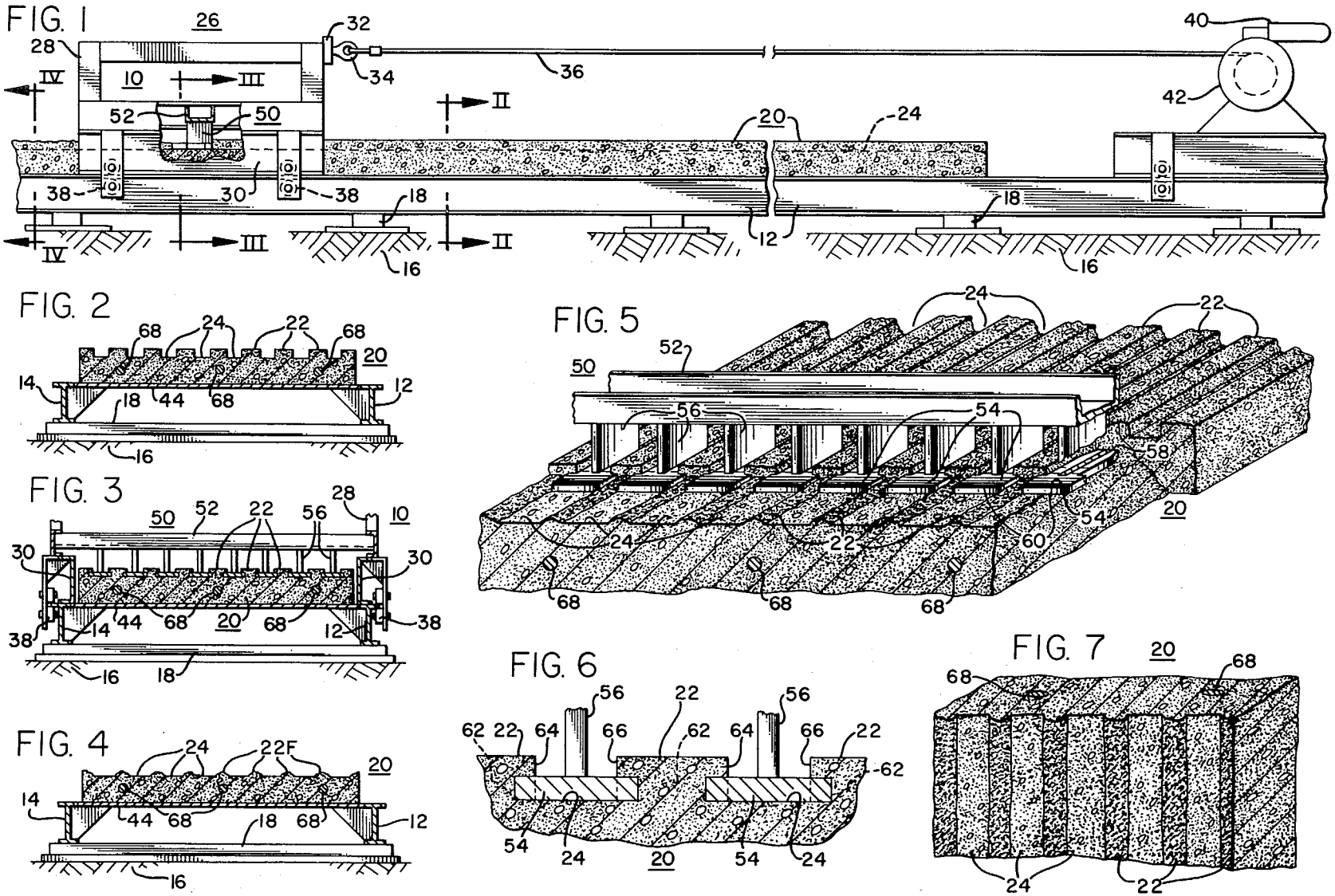
FIG. 1 is a side elevational view of apparatus constructed according to the present invention.
FIG. 2 is a sectional view taken along the line II—II in FIG. 1.
FIG. 3 is a sectional view taken along the line III—III of FIG. 1.
FIG. 4 is a sectional view taken along the line IV—IV of FIG. 1.
FIG. 5 is an isometric view which illustrates construction details and operation of the wedge assembly of FIG. 1.
FIG. 6 is an enlarged view of a portion of FIG. 3.
FIG. 7 is an isometric view of a concrete panel having a fractured rib surface finish produced by the apparatus and method of the invention.

A rib breaking machine constructed according to the present invention is indicated generally by the reference numeral 10 in FIG. 1 of the drawing. The rib breaker assembly 10 is shown mounted on a pair of spaced rails 12 and 14 anchored in a solid supporting bed 16 by anchors 18. The rib breaker apparatus 10 is movable longitudinally of an elongated, prestressed, concrete slab member 20 which has been previously extruded to form projecting ribs 22 and channels 24 along the top exposed face of the slab 20, for example according to the method of our co-pending application Ser. No. 722,587. The guide rails 12 and 14 are rigidly secured to the supporting bed 16 in order to support the rib breaking apparatus 10 and to absorb the reaction force during the rib breaking operation as will be hereinafter explained.

The rib breaker apparatus 10 includes a carriage 26 having an upright superstructure 28 which is supported by side walls 30, all interconnected through conventional use of welded angle iron members to provide an overall rigid structure. A beam 32 is secured to the superstructure and includes a hitching eye 34 through which a cable 36 is secured. The rib breaker assembly 10 is equipped with roller assemblies 38 to roll along the flanges of the guide rails 12 and 14. The rib breaker assembly 10 is propelled along the guide rails 12, 14 by means of a driving motor 40 which winds the cable 36 around a winch 42 situated near one end of the slab 20.

The guide rails 12, 14 support a casting bed or pallet 44 which is typically several hundred feet in length. The carriage 26 is movable longitudinally along the length of the slab 20 on the guide rails 12 and 14 and is held in the proper axial alignment with the pallet 44 by the roller assemblies 38.

The rib breaker assembly 10 includes an array 50 of wedges which are secured to a beam 52 which forms a part of the superstructure 28. The beam 52 extends transversely with respect to the pallet 44 and is elevated above the slab 20. Wedge members 54 are secured to the beam 52 by means of struts 56 as shown in FIGS. 3 and 5 of the drawing. Each wedge member includes a nose portion 58 which is narrow enough to permit its insertion into a channel disposed between a pair of adjacent ribs. The wedge members 54 also include a shoulder portion 60 which is wider than the channel 24 for shearing and forcibly displacing portions of the adjacent ribs as the wedges 54 are drawn through the channels. The wedges 54 are elevated with respect to the pallet 44 and are spaced apart laterally with respect to each other to permit insertion of the nose portions 58 into the channels 24.

Referring now to FIGS. 5 and 6, the wedges 54 are preferably secured to the beam 56 substantially in a straight line so that each rib 22 is engaged by a pair of wedges substantially simultaneously to create a fracture line 62 extending across the face of the rib as the wedges are drawn through the channels. The width of the nose portions 58 of each wedge is substantially equal to the width of the channel 24 into which it is inserted to permit nesting engagement of the nose portions with the surface of the slab 20 and the sides 64, 66 of adjacent ribs which define the corresponding channels. This nesting arrangement provides positive alignment of each wedge and prevents twisting of the struts 56 and misalignment of the wedges 54 which might otherwise occur during the fracturing procedure.

According to the method of the invention, a quantity of relatively low slump concrete mixture is cast upon the pallet 44 in the form of a panel or slab 20. Preferably a relatively stiff, low slump mixture is used for casting so that the extruded ribs 22 will remain intact until the slab is completely set. The use of a slump concrete mixture as opposed to a relatively dry mixture results in a more consistent end product without having voids and defects therein which are conventionally found when using a relatively dry or no slump type concrete material. Additionally, a uniform strong bond is established between the concrete and prestressed structural members 68 (FIGS. 2, 3, 4 and 7) which may be included. The moisture laden slump concrete material eliminates slippage of the prestressed structure and loss of prestress which is often found when using a dry or no slump concrete material.

It has been found that a concrete mixture characterized by a slump test in the range of 1.0 to 2.5 is most desirable in producing the extruded concrete slab product by the method and apparatus as taught by our co-pending application cited above. However, for purposes of the present invention, it is necessary to permit the extruded slab to set for a predetermined period after the ribs have been formed so that the ribs will fracture rather than undergo plastic deformation when the carriage 26 and wedge array 50 are drawn along the pallet 44. The slab casting 20 is permitted to harden until the concrete becomes rigid but is not completely set. For relatively low slump concrete mixture characterized by slump tests in the range of 1.0 to 2.5 under the ASTM testing standard, the slab 20 should be permitted to harden for at least one hour but not more than four hours prior to performing the fracturing procedure.

During the fracturing procedure, a shearing force is applied by the wedge array 50 against each partially set rib 22 in a direction substantially parallel to the orientation of the ribs and perpendicular to a plane containing a right angle cross section of the ribs. As the wedge members 54 are drawn through the channels, portions of the rib disposed above the fracture line 62 are broken away thereby exposing the aggregate underneath to provide a simulated hammered rib finish as illustrated in FIG. 7 of the drawing. The fractured portions of the ribs can be broomed away from the finished surface with a cleaning brush attachment which is ordinarily used to clean the pallet. The fractured rib surface can additionally be sandblasted for added effect.

The rib breaking apparatus of the invention is operable to produce a fractured rib finish on a prestressed, reinforced slab of indefinite length from a slump type material which is permitted to set for a relatively short period of time. The carriage may be propelled by any suitable convenient means and may be used in combination with the concrete panel extruding apparatus described in our co-pending application. The rib breaking apparatus is substantially maintenance free and is operable to save many man-hours as compared to the conventional production technique of manually hammering the ribs.

Although a preferred embodiment of the invention has been described in detail, it should be understood that various changes, substitutions, and alterations can be made therein without departing from the spirit and scope of the invention as defined by the appended claims.

What is claimed is:

1. A method for producing a concrete panel having a fractured rib finish comprising:

(a) casting a quantity of relatively low slump concrete mixture on a pallet in the form of a panel;

(b) extruding the casting to define projecting ribs and channels between the ribs extending in a parallel pattern along the length of the panel;

(c) permitting the casting to harden until the concrete becomes rigid but not completely set; and, (d) applying a shearing force against each rib by drawing an array of wedges through the channels along the length of the rigid but not completely set casting with each wedge disposed in shearing engagement with edge portions of adjacent ribs.

2. The method as defined in claim 1 wherein the relatively low slump concrete casting is permitted to harden according to step (c) for at least one hour but not more than four hours prior to performing step (d).

* * * * *